US009079744B2

(12) United States Patent
Watanabe et al.

(10) Patent No.: US 9,079,744 B2
(45) Date of Patent: Jul. 14, 2015

(54) SHEET FOLDING APPARATUS

(75) Inventors: Shinya Watanabe, Shiga (JP); Tatsuaki Ida, Shiga (JP); Yoshikazu Nakamura, Shiga (JP)

(73) Assignee: HORIZON INTERNATIONAL INC., Shiga (JP)

( * ) Notice: Subject to any disclaimer, the term of this patent is extended or adjusted under 35 U.S.C. 154(b) by 752 days.

(21) Appl. No.: 13/391,888

(22) PCT Filed: Aug. 26, 2009

(86) PCT No.: PCT/JP2009/064872

§ 371 (c)(1),
(2), (4) Date: Mar. 14, 2012

(87) PCT Pub. No.: WO2011/024266

PCT Pub. Date: Mar. 3, 2011

(65) Prior Publication Data

US 2012/0172189 A1 Jul. 5, 2012

(51) Int. Cl.
*B31F 1/00* (2006.01)
*B31F 1/08* (2006.01)
(Continued)

(52) U.S. Cl.
CPC ..... *B65H 45/144* (2013.01); *B65H 7/10* (2013.01); *B65H 9/04* (2013.01); *B65H 11/002* (2013.01); *B65H 45/142* (2013.01);
(Continued)

(58) Field of Classification Search
CPC ... B65H 45/144; B65H 45/142; B65H 45/147
USPC ..... 493/419–422, 395, 397, 402, 405
See application file for complete search history.

(56) References Cited

U.S. PATENT DOCUMENTS 1,841,755 A * 1/1932 Mitchell et al. ..... 493/397
1,848,448 A * 3/1932 Weidner ..... 493/421
(Continued)

FOREIGN PATENT DOCUMENTS

JP 58177852 10/1983
JP 61197368 1/1986
(Continued)

*Primary Examiner* — Stephen F Gerrity
*Assistant Examiner* — Eyamindae Jallow
(74) *Attorney, Agent, or Firm* — Kirschstein, et al.

(57) ABSTRACT

A paper folding device is configured so that a folding line is always formed at a predetermined position of paper sheets. A paper supply section is provided with a conveyor belt for conveying paper sheets (P) sequentially supplied from a paper sheet stack. A guide plate (4) for aligning the positions of the conveyed paper sheets is provided on a conveying surface of the conveyor belt. A paper folding section has a buckle (10) comprising an outer frame (11) and bars (12) which extend between opposite sides (11*a*, 11*b*) of the outer frame and are arranged at intervals from each other. Paper sheet introducing gaps extended in the direction of the length of the bars are provided in the buckle. Before the start of paper folding operation, a control section calculates and processes data relating to the size of paper sheets and data relating to the position of the bars, so that the distance to the guide plate from a reference point in the direction perpendicular to the conveying direction (R) is set to a value with which a side edge of each paper sheet introduced into the paper sheet introducing gaps in the buckle is separated by a distance not less than a predetermined level from a side edge of a bar located closest to the side edge of the paper sheet. Then, the control section sets the position of the guide plate according to the set value.

2 Claims, 5 Drawing Sheets

(51) Int. Cl.

| | |
|---|---|
| ***B65H 45/14*** | (2006.01) |
| ***B65H 7/10*** | (2006.01) |
| ***B65H 9/04*** | (2006.01) |
| ***B65H 11/00*** | (2006.01) |

(52) U.S. Cl.

CPC ..... *B65H 2403/52* (2013.01); *B65H 2511/10* (2013.01); *B65H 2511/20* (2013.01); *B65H 2511/22* (2013.01); *B65H 2551/10* (2013.01); *B65H 2557/23* (2013.01); *B65H 2557/24* (2013.01)

(56) References Cited

U.S. PATENT DOCUMENTS

| | | | | | |
|---|---|---|---|---|---|
| 1,969,049 | A | * | 8/1934 | Spiess | 493/420 |
| 3,150,871 | A | * | 9/1964 | Boblit, Jr. et al. | 493/421 |
| 3,211,448 | A | * | 10/1965 | Stoothoff | 493/421 |
| 3,481,596 | A | * | 12/1969 | Porth | 493/421 |
| 4,898,570 | A | * | 2/1990 | Luperti et al. | 493/420 |
| 5,129,876 | A | * | 7/1992 | Brabant et al. | 493/471 |
| 5,183,246 | A | * | 2/1993 | Edwards et al. | 270/45 |
| 5,194,064 | A | * | 3/1993 | Simpson et al. | 493/402 |
| 5,269,744 | A | * | 12/1993 | Moll | 493/421 |
| 5,364,332 | A | * | 11/1994 | Gray, Jr. | 493/23 |
| 5,437,596 | A | * | 8/1995 | Bogdan et al. | 493/420 |
| 5,573,231 | A | | 11/1996 | Stab | |
| 5,769,774 | A | * | 6/1998 | Beck et al. | 493/421 |
| 5,871,433 | A | * | 2/1999 | Lehmann et al. | 493/420 |
| 5,876,320 | A | * | 3/1999 | LeCompte | 493/125 |
| 5,967,963 | A | * | 10/1999 | Gotting | 493/420 |
| 6,059,711 | A | * | 5/2000 | Wang | 493/360 |
| 6,086,522 | A | * | 7/2000 | Hechler | 493/23 |
| 6,602,176 | B1 | * | 8/2003 | Ganneval | 493/405 |
| 6,641,514 | B1 | * | 11/2003 | Hechler | 493/8 |
| 6,708,967 | B1 | * | 3/2004 | Trovinger et al. | 270/52.26 |
| 6,857,996 | B2 | * | 2/2005 | Dorer | 493/419 |
| 7,125,374 | B2 | * | 10/2006 | Abramson et al. | 493/420 |
| 7,214,176 | B2 | * | 5/2007 | Abramson et al. | 493/476 |
| 8,029,429 | B2 | * | 10/2011 | Tsai | 493/402 |
| 8,424,859 | B2 | * | 4/2013 | Ishikawa et al. | 270/45 |
| 2003/0022780 | A1 | * | 1/2003 | Ifkovits et al. | 493/419 |
| 2005/0159286 | A1 | * | 7/2005 | Morelli et al. | 493/405 |
| 2008/0108492 | A1 | * | 5/2008 | Zechner | 493/419 |
| 2008/0234118 | A1 | * | 9/2008 | Ishida et al. | 493/23 |
| 2008/0260446 | A1 | * | 10/2008 | Harasawa | 399/408 |
| 2009/0111673 | A1 | * | 4/2009 | Bober | 493/405 |
| 2010/0016138 | A1 | * | 1/2010 | Clarke et al. | 493/421 |
| 2010/0075821 | A1 | * | 3/2010 | Terlau | 493/419 |
| 2010/0137119 | A1 | * | 6/2010 | Vallonthaiel | 493/421 |
| 2012/0108411 | A1 | * | 5/2012 | Seki | 493/395 |
| 2012/0184423 | A1 | * | 7/2012 | Hattori | 493/405 |
| 2012/0238422 | A1 | * | 9/2012 | Watanabe et al. | 493/18 |
| 2013/0053230 | A1 | * | 2/2013 | Nakamura | 493/405 |

FOREIGN PATENT DOCUMENTS

| | | |
|---|---|---|
| JP | S6175467 | 5/1986 |
| JP | 05201610 | 10/1993 |
| JP | 2002160852 | 6/2002 |
| JP | 2004345773 | 12/2004 |
| JP | 2007308209 | 11/2007 |

* cited by examiner (A)

(B)

SHEET FOLDING APPARATUS

TECHNICAL FIELD

The present invention relates to a sheet folding apparatus and, more particularly, to a sheet folding apparatus in which sheets are folded by folding rollers at a right angle to a sheet feeding direction.

BACKGROUND ART

There has been conventionally known a sheet folding apparatus for folding a sheet at a right angle to a sheet feeding direction by nipping the sheet between a pair of folding rollers (also see, for example, Patent Documents 1 and 2). The sheet folding apparatus of this type includes a sheet feeding section for sequentially feeding sheets from a sheet stack and a sheet folding section for folding the sheet fed from the sheet feeding section at a right angle to the sheet feeding direction.

The sheet feeding section includes a rack on which the sheet stack is placed, a conveyor belt extending between the rack and the sheet folding section and rotationally driven, and a sheet feeder for sequentially feeding the sheet from the sheet stack on the rack onto a conveying surface of the conveyor belt.

Furthermore, a guide plate is mounted on the conveyor belt for aligning the sheet to be conveyed. The guide plate extends in the conveyance direction and is movable on the conveyor belt in a direction perpendicular to the conveyance direction. The sheet is conveyed on the conveyor belt in contact with the guide plate at one side edge thereof.

The sheet folding section includes buckles. Each of the buckles has a rectangular outer frame and a plurality of bars which extend between a pair of opposite sides of the outer frame and are spaced each other. Each of the plurality of bars includes a pair of bar elements spaced in a thickness direction of the outer frame. A slot is formed at one of the pair of opposite sides of the outer frame and communicates with a clearance defined between the pair of bar elements of each of the bars. Inside of the buckle is formed a sheet feed clearance extending from the slot into a longitudinal direction of the bar. The buckle is arranged in such a way that the slot is oriented toward the conveyor belt.

A stopper is arranged in the sheet feed clearance of the buckle. When the leading edge of the sheet abuts against the stopper, the sheet is positioned at a predetermined folding position. A pair of inlet rollers is arranged immediately before the slot of the buckle and rotationally driven, so that the sheet fed by the conveyor belt is nipped therebetween, and then fed into the sheet feed clearance of the buckle. A pair of folding rollers is arranged in the proximity of and in parallel to the pair of inlet rollers and rotationally driven so as to fold a portion of the sheet bent outside of the buckle.

In the above-described conventional sheet folding apparatus, a control section receives data of the size of the sheet prior to the start of a sheet folding operation. The control section sets the position of the guide plate of the sheet feeding section based on the data in such a way that the sheet is fed at the center of the buckle of the sheet folding section. Upon the start of the sheet folding operation, the sheets are sequentially delivered between the pair of inlet rollers from the conveyor belt, to be then fed into the buckle. The portion of the sheet bent outside of the buckle is nipped between the pair of folding rollers, and thus, the sheet is folded at the predetermined folding position.

However, in the above-described conventional sheet folding apparatus, occasionally, the sheet may not be accurately folded at the predetermined folding position, so that a deficient product may be produced. It is proved that this failure is not caused by sheet jamming, but the cause of this failure has not been found out heretofore.

Accordingly, in the prior art, an occasional deviation of a sheet folding position is corrected by adjusting parts of a sheet folding apparatus relying on operator's skill and hunch.

PRIOR ART LITERATURE

Patent Documents

Patent Document 1: JP 2004-345773 A
Patent Document 2: JP 2007-308209 A

SUMMARY OF INVENTION

Problems to be Solved by the Invention

The inventors has investigated in detail the cause of the occasional deviation of the folding position of the sheet, and found out that the deviation of the folding position is occurred in the case that a side edge of the sheet is located in the vicinity of a side edge of the bar of the buckle when the sheet is fed from the conveyor belt to the buckle, the sheet may not be sometimes aligned at the correct folding position by the contact of the side edge of the sheet with the side edge of the bar of the buckle during the insertion of the sheet into the sheet feed clearance of the buckle.

In the light of a result of the investigation of the cause, it is an object of the present invention to form a folding line at a predetermined position of a sheet all the time in a sheet folding apparatus.

Means for Solving the Problems

In order to achieve the object, the present invention provides a sheet folding apparatus comprising: a sheet feeding section for sequentially feeding sheets from a sheet stack; a sheet folding section for folding the sheet fed from the sheet feeding section at a right angle to a sheet feeding direction; and a control section for controlling the sheet feeding section and the sheet folding section, the sheet feeding section including: a rack on which the sheet stack is placed; a conveyor belt extending between the rack and the sheet folding section and being rotationally driven; a sheet feeder for sequentially feeding the sheets from the sheet stack onto a conveying surface of the conveyor belt; a guide plate extending in a conveyance direction on the conveying surface of the conveyor belt so as to align the sheet conveyed on the conveying surface; and a guide plate drive mechanism for moving the guide plate on the conveying surface in a direction perpendicular to the conveyance direction, the sheet being brought into contact with the guide plate at one side edge thereof while being conveyed on the conveying surface, the sheet folding section including: a buckle having a rectangular outer frame; and a plurality of bars, each of the plurality of bars extending between a pair of sides of the outer frame with intervals therebetween, each of the plurality of bars being composed of a pair of bar elements arranged with a clearance in a thickness direction of the outer frame, a slot being formed at one side of the pair of sides of the outer frame and extending in an array direction of the bars so as to communicate with the clearance defined between the pair of bar elements of each of the bars, a sheet feed clearance being formed inside of the buckle and extending in a length direction of the bars from the slot, the buckle being arranged in such a way that the slot is oriented toward the conveyor belt; the sheet folding section further including a stopper arranged on the way of the sheet feed clearance of the buckle for positioning the sheet at a predetermined folding position by the leading edge of the sheet abutting against the stopper; a pair of inlet rollers arranged immediately before the slot of the buckle for rotation around a rotary shaft which extends at a right angle to the conveyance direction, the pair of the inlet rollers nipping the sheet fed from the conveyor belt so as to feed the sheet into the sheet feed clearance of the buckle; and a pair of folding rollers arranged in parallel to the inlet rollers and rotationally driven for folding a portion of the sheet bent outside of the buckle, the control section C including: a data storage section for storing data of bar position representing a distance from a reference point in a direction perpendicular to the conveyance direction to both side edges of the bar of the buckle; and a data input section for receiving an input of data of a sheet size, the control section C executing the arithmetic processing of the data of the sheet size and the data of the bar position prior to the start of a sheet folding operation so as to determine the reference value of a distance from the reference point to the guide plate in a direction perpendicular to the conveyance direction in such a manner that each of the side edges of the sheet to be fed into the sheet feed clearance of the buckle is separated by not less than the predetermined distance from side edges of the bar positioned nearest the side edges of the sheet, and setting a position of the guide plate in accordance with the reference value of the distance.

In a preferred embodiment according to the present invention, when the sheet is fed from the conveyor belt of the sheet feeding section to the buckle of the sheet folding section in such a manner that the center axis of the sheet matches with the center axis of the buckle and when the reference point in the direction perpendicular to the conveyance direction is set on the center axes both of the buckle and the conveyor belt, in the arithmetic processing, the control section determines values p and q in accordance with the following equation:

(i)

$$(D/2-M/2)/L=p \ldots q \tag{1}$$

wherein D represents a width of the sheet, L represents an interval between the bars, and M represents a width of the clearance defined between the adjacent bars, and, (ii) when $0 \leq q \leq W$, wherein W represents the predetermined distance between each of the side edges of the sheet and the side edges of the bar positioned nearest the side edges of the sheet, the control section determines the reference value of the distance X from the reference point to the guide plate (4) as $$X=L/2+L\times p \tag{2}$$

(iii) when $W<q<L-W$, the control section determines the reference value of the distance X as $$X=D/2 \tag{3}$$

(iv) when $L-W \leq q<L$, the control section determines the reference value of the distance X as $$X=L/2+L\times(p+1) \tag{4}$$

and further, the control section determines values r and s in accordance with the following equation:

(v)

$$[(D/2-(M/2+(L-M))]/L=r \ldots s \tag{5}$$

and, (vi) when $0 \leq s \leq W$, the control section determines the reference value of the distance X as $$X=L/2+L\times r \tag{6}$$

(vii) when $W<s<L-W$, the control section determines the reference value of the distance X as $$X=D/2 \tag{7}$$

(viii) when $L-W \leq q<L$, the control section determines the reference value of the distance X as $$X=L/2+L\times(r+1) \tag{8}$$

In another preferred embodiment according to the present invention, the guide plate drive mechanism includes: a frame; a feed screw extending across a clearance defined between the upper and lower sides of the conveyor belt at a right angle to the conveyance direction and supported by the frame so as to be rotated around an axis thereof; a motor fixed to the frame and connected to one end of the feed screw so as to rotationally drive the feed screw; a movable block having a dimension suitable for insertion into the clearance defined between the upper and lower sides of the conveyor belt, the feed screw being screwed through the movable block; and guide rails attached to the frame and extending in parallel to the feed screw so as to slidably guide the movable block in a direction perpendicular to the conveyance direction, wherein the guide plate is attached to the movable block.

Advantages of the Invention

According to the present invention, before the start of the sheet folding operation, the reference value of the distance from the reference point to the guide plate in the direction perpendicular to the conveyance direction is determined in such a manner that each of the side edges of the sheet to be fed into the sheet feed clearance of the buckle is separated by not less than the predetermined distance from the side edges of the bar positioned nearest the side edges of the sheet, and the position of the guide plate is set in accordance with the reference value of the distance. Consequently, during the insertion of the sheet into the sheet feed clearance of the buckle, the side edges of the sheet are not brought into contact with the side edges of the bar of the buckle, so that the sheet is accurately aligned at the predetermined folding position all the time without any deviation of the folding position.

BEST MODE FOR CARRYING OUT THE INVENTION

Figure 1:
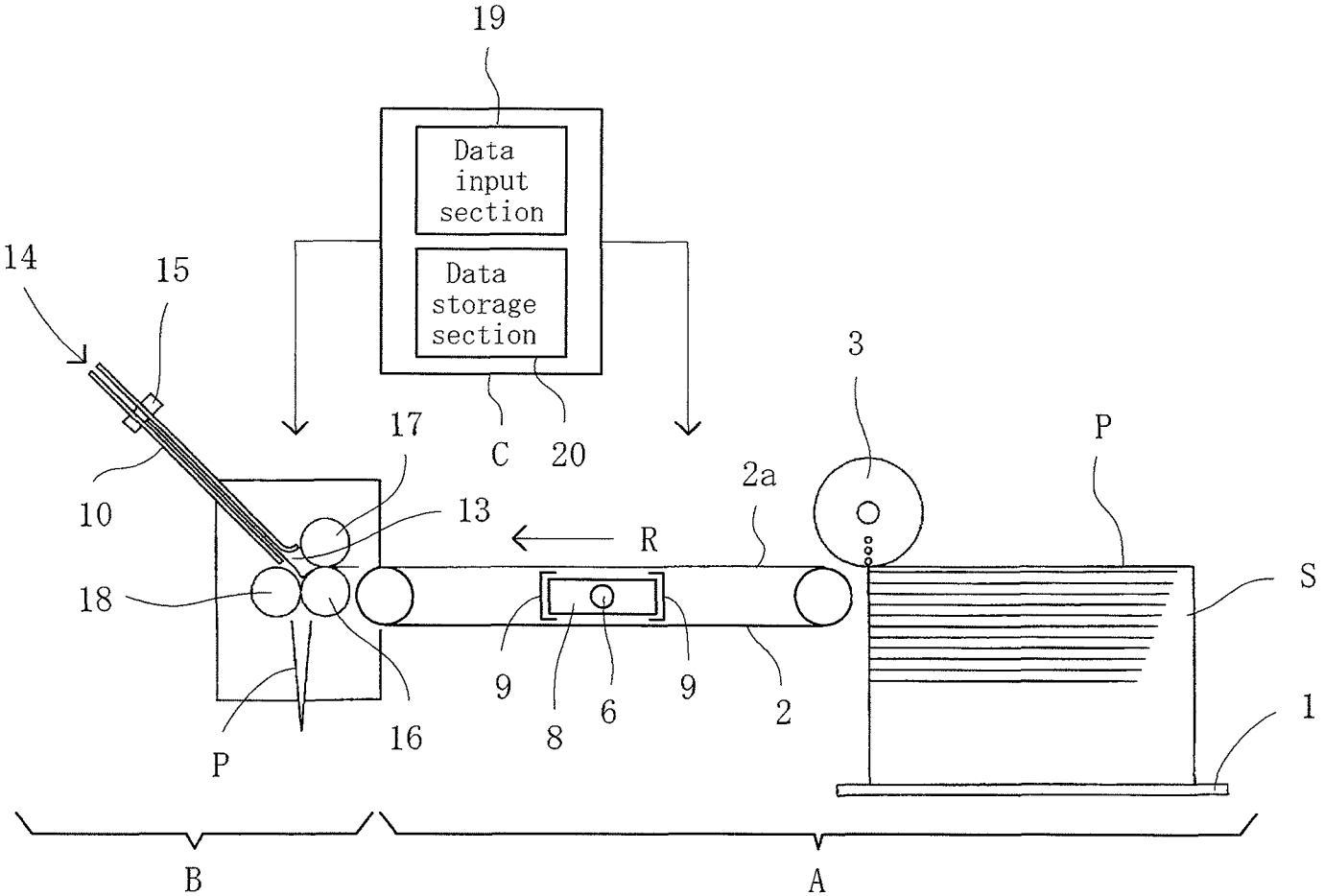
FIG. 1 is a side view schematically showing a sheet folding apparatus in a preferred embodiment according to the present invention.
Figure 2:
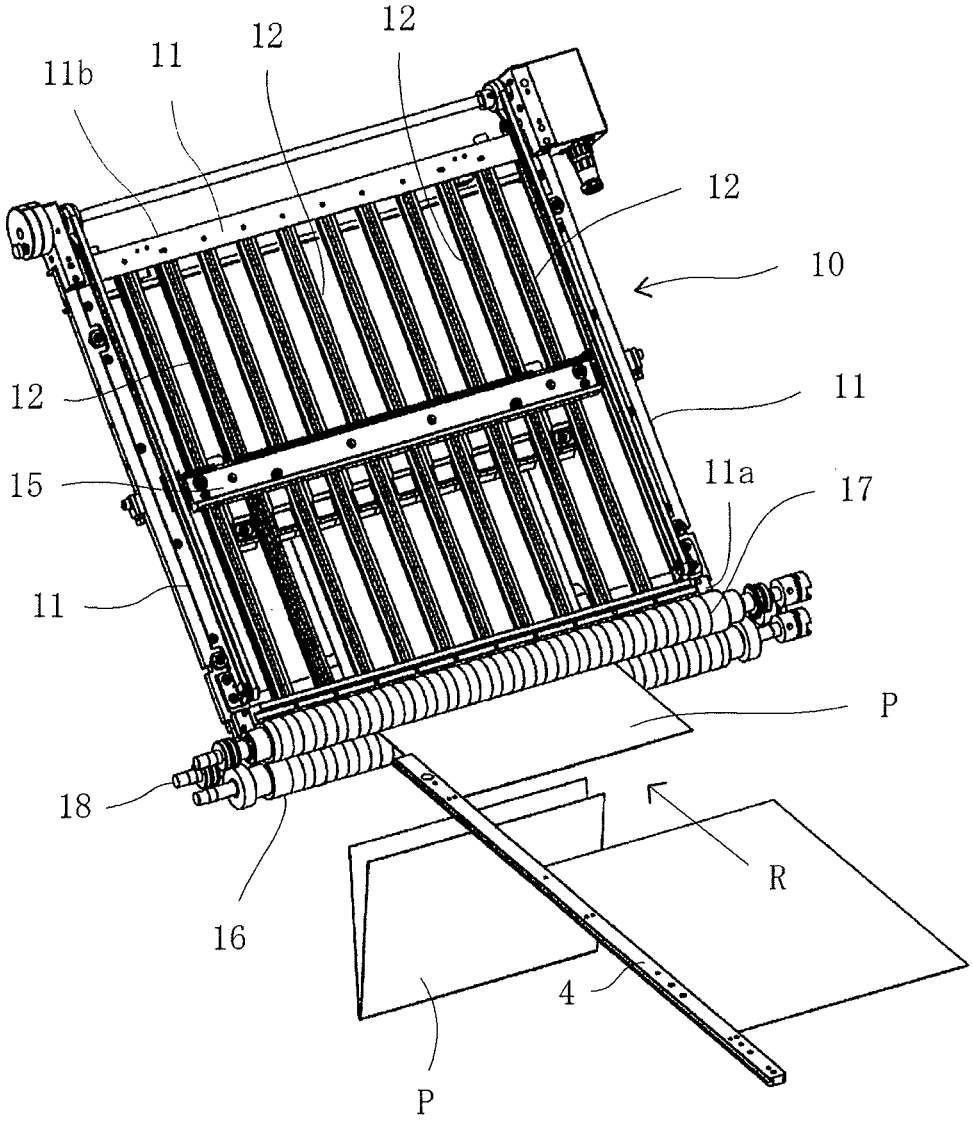
FIG. 2 is a perspective view showing main components in the vicinity of a buckle of the sheet folding apparatus shown in FIG. 1.
Figure 3:
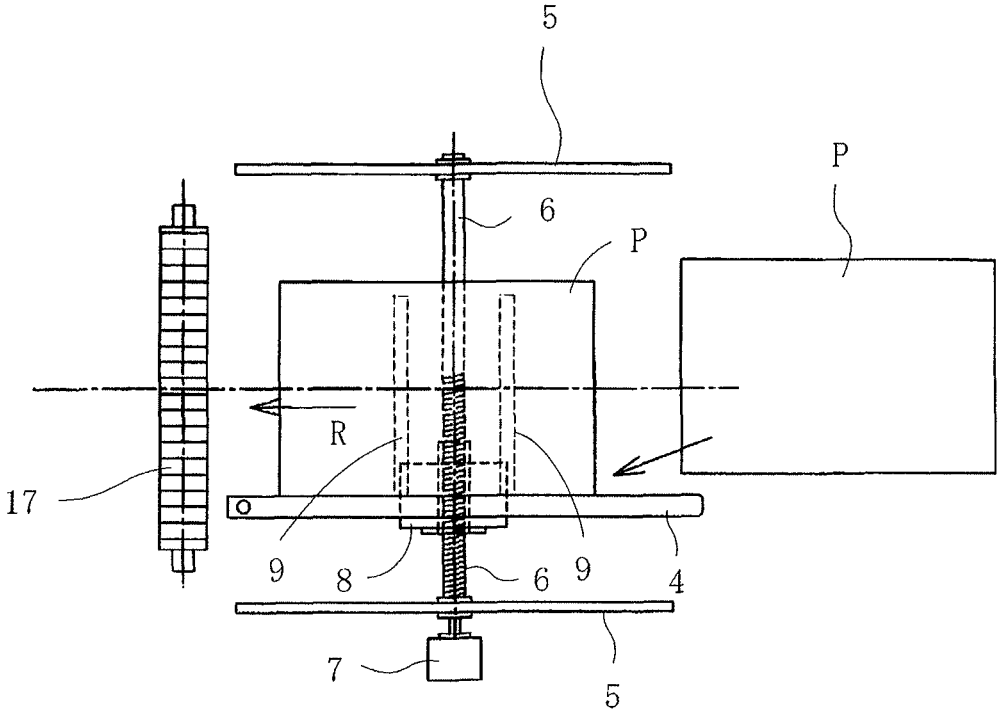
FIG. 3 is a plan view showing a guide plate drive mechanism of the sheet folding apparatus shown in FIG. 1.

A preferred embodiment according to the present invention will be explained below with reference to the attached drawings. FIG. 1 is a side view schematically showing a sheet folding apparatus in a preferred embodiment according to the present invention. FIG. 2 is a perspective view showing main components in the vicinity of a buckle in the sheet folding apparatus shown in FIG. 1. FIG. 3 is a plan view showing a guide plate drive mechanism of the sheet folding apparatus shown in FIG. 1.

As shown in FIG. 1, the sheet folding apparatus according to the present invention includes a sheet feeding section A for sequentially feeding sheets P from a sheet stack S, a sheet folding section B for folding the sheet P fed from the sheet feeding section A at a right angle to a sheet feeding direction and a control section C for controlling the sheet feeding section A and the sheet folding section B.

The sheet feeding section A includes: a lifting and lowering rack 1 on which the sheet stack S is placed, a conveyor belt 2 extending between the rack 1 and the sheet folding section B and being rotationally driven, and a feed roller 3 for sequentially feeding an uppermost sheet P of the sheet stack S on the rack 1 onto a conveying surface 2*a* of the conveyor belt 2.

The sheet feeding section A further includes a guide plate 4 extending in a conveyance direction (indicated by an arrow R) on the conveying surface 2*a* of the conveyor belt 2 so as to align the sheet conveyed on the conveying surface 2*a*, and a guide plate drive mechanism for moving the guide plate 4 in a direction perpendicular to the conveyance direction R on the conveying surface 2*a*. As shown in FIG. 2, the sheet P is brought into contact with the guide plate 4 at one side edge thereof while being conveyed on the conveying surface 2*a*. Here, the conveyance direction R matches with a sheet feeding direction for the sheet folding section B.

As shown in FIGS. 1 and 3, the guide plate drive mechanism includes a frame 5. A feed screw 6 is supported by the frame 5 so as to be rotated around an axis thereof and extends across a clearance defined between the upper and lower sides of the conveyor belt 2 at a right angle to the conveyance direction R. A motor 7 is fixed to the frame 5 and a drive shaft for the motor 7 is connected to one end of the feed screw 6 so as to rotationally drive the feed screw 6.

The guide plate drive mechanism has a movable block 8 having a dimension suitable for insertion into the clearance defined between the upper and lower sides of the conveyor belt 2, and then the feed screw 6 is screwed through the movable block 8. Furthermore, the guide plate drive mechanism has mechanism has guide rails 9 attached to the frame 5 and extending in parallel to the feed screw 6 so as to slidably guide the movable block 8 in the direction perpendicular to the conveyance direction R. The guide plate 4 is attached to the movable block 8.

In this manner, when the feed screw 6 is rotationally driven by the motor 7, the movable block 8 slides in the direction perpendicular to the conveyance direction R, and thus, the guide plate 4 is moved in the direction perpendicular to the conveyance direction R.

The sheet folding section B includes a buckle 10 having a rectangular outer frame 11 and a plurality of bars 12 each of which extends between a pair of sides 11*a* and 11*b* of the outer frame 11 with intervals therebetween.

Figure 4:
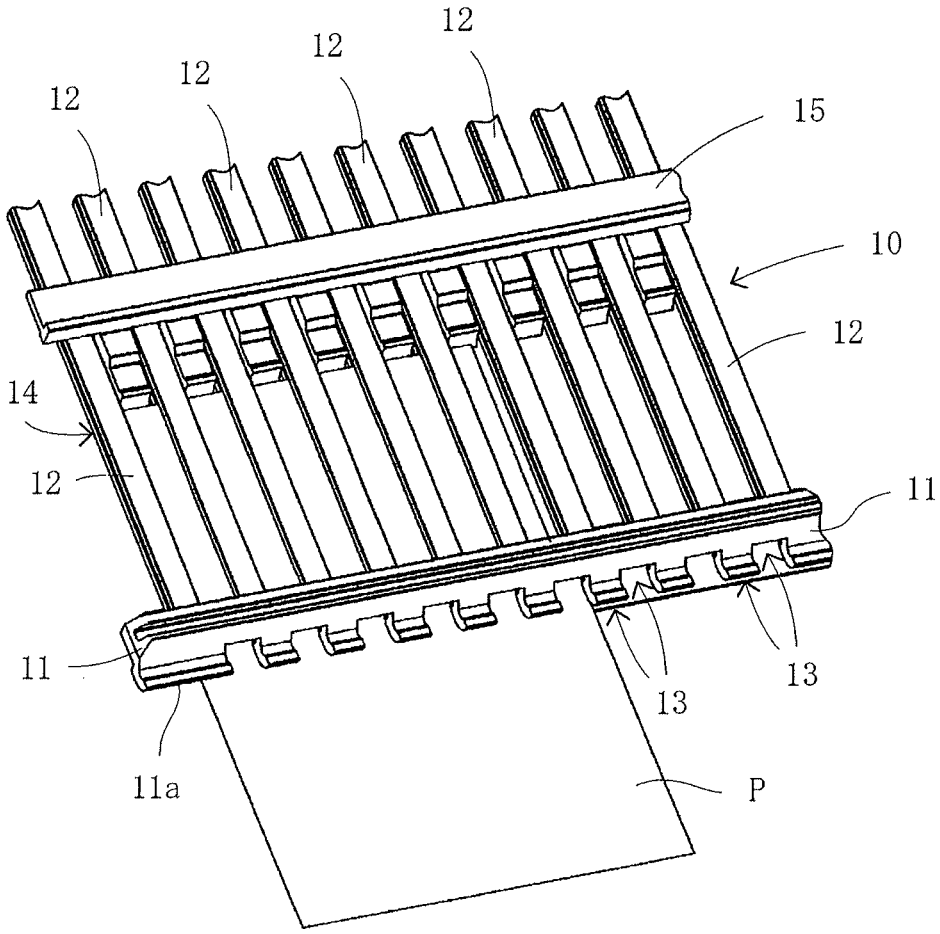
FIG. 4 is a perspective view showing the buckle of the sheet folding apparatus shown in FIG. 1.

FIG. 4 is a perspective view showing the buckle of the sheet folding apparatus shown in FIG. 1. FIG. 5A is a cross-sectional view showing the buckle shown in FIG. 4, taken along the direction perpendicular to the sheet feeding direction, and FIG. 5B is a partly enlarged view of FIG. 5A.

As shown in FIGS. 4, 5A, and 5B, each of the plurality of bars 12 consists of a pair of bar elements 12*a* and 12*b* arranged with a clearance in a thickness direction of the outer frame 11. A slot 13 is formed at one side 11*a* of the pair of sides 11*a* and 11*b* of the outer frame 11 and extends in an array direction of the bars 12 so as to communicate with the clearance defined between the pair of bar elements 12*a* and 12*b* of each of the bars 12. A sheet feed clearance 14 is formed inside of the buckle 10 and extends in a length direction of the bars 12 from the slot 13. The buckle 10 is arranged in such a manner that the slot 13 is oriented toward the conveyor belt 2.

A stopper 15 is arranged on the way of the sheet feed clearance 14 of the buckle 10. The stopper 15 positions the sheet P at a predetermined folding position by the leading edge of the sheet P abutting against the stopper 15.

A pair of inlet rollers 16 and 17 is arranged immediately before the slot 13 of the buckle 10 for rotation around a rotary shaft extending at a right angle to the sheet feeding direction R. The pair of inlet rollers 16 and 17 nips the sheet P fed from the conveyor belt 2 therebetween so as to feed the sheet P into the sheet feed clearance 14 of the buckle 10. A pair of folding rollers 17 and 18 is arranged in parallel and oppositely to the inlet rollers 16 and 17 and rotationally driven for folding a portion of the sheet P bent outside of the buckle 10. In other words, immediately before the slot 13 of the buckle 10, the fixed roller 17 arranged in place and the position-adjustable roller 16 are arranged oppositely to each other, and the fixed roller 17 and the position-adjustable roller 18 are arranged oppositely to each other.

The control section C includes a data storage section 20 for storing data of bar position representing a distance from a reference point in a direction perpendicular to the conveyance direction R to both side edges 12*c* and 12*d* of the bar 12 of the buckle 10, and a data input section 19 for receiving an input of data of a sheet size.

The control section C executes the arithmetic processing of the data of the sheet size and the data of the bar position prior to the start of a sheet folding operation so as to determine the reference value of a distance from the reference point to the guide plate 4 in the direction perpendicular to the conveyance direction R in such a manner that each of the side edges of the sheet P to be fed into the sheet feed clearance 14 of the buckle 10 is separated by not less than a predetermined distance from side edges 12*c* and 12*d* of the bar 12 positioned nearest the side edges of the sheet P. Then the control section C sets a position of the guide plate 4 according to the reference value of the distance.

Figure 5:
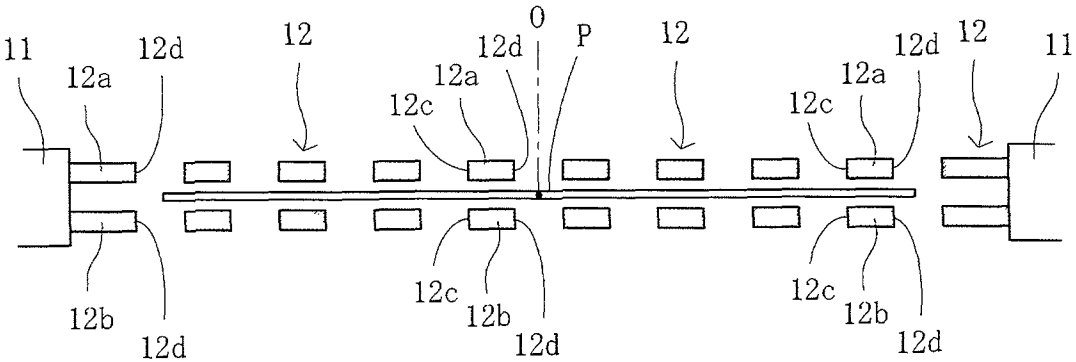
FIG. 5A is a cross-sectional view showing the buckle shown in FIG. 4, taken along a direction perpendicular to a sheet feeding direction.
FIG. 5B is a partly enlarged view of FIG. 5A.
Figure 5:
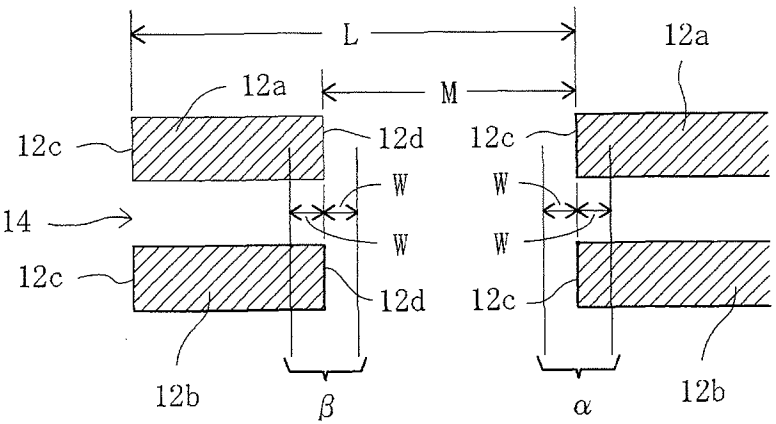

The method of determination of the reference value of the distance from the reference point to the guide plate 4 by the control section C will be explained below with reference to FIG. 5. In this embodiment, the sheet is fed from the conveyor belt 2 of the sheet feeding section A to the buckle 10 of the sheet folding section B in such a way that the center axis of the sheet P matches with the center axis of the buckle 10, and that the reference point O in the direction perpendicular to the conveyance direction R is set on the center axes both of the buckle 10 and the conveyor belt 2.

As illustrated in FIG. 5B, variables are defined below in the method.

D=a width of the sheet P (i.e., a size in the direction perpendicular to the conveyance direction R)

L=an interval between the bars 12

M=a width of a clearance defined between the adjacent bars 12

W=a predetermined distance between each of the side edges of the sheet P and the side edges 12*c* and 12*d* of the bar 12 positioned nearest the side edges of the sheet P X=a reference value of a distance from the reference point O to the guide plate 4 in the direction perpendicular to the conveyance direction R Based on the width D of the sheet P (data of the size of the sheet), the interval L between the bars 12, and the width M of the clearance between the adjacent bars 12 (data of a bar position), the control section C determines whether each of the side edges of the sheet P to be fed into the buckle 10 is positioned inside or outside of an area α which falls within the range of the distance W from the side edge 12*c* toward the reference point O of the bar 12, and whether each of the side edges of the sheet P to be fed into the buckle 10 is positioned inside or outside of an area β which falls within the range of the distance W from the side edge 12*d* away from the reference point O of the bar 12. Then the control section C determines the reference value of the distance X according to the result of the determination. Namely, (i) In area α:

The control section C determines values p and q in accordance with the following equation:

$$(D/2-M/2)/L=p \ldots q \quad (1)$$

Then the control section C determines the reference value of the distance X in each of the following three cases relative to the value of q.

(a) When $0 \leq q \leq W$, each of the side edges of the sheet P falls within the area α, and therefore, the control section C determines the reference value of the distance X in such a way that each of the side edges of the sheet P is positioned outside of the area α, that is, as $$X=L/2+L\times p \quad (2)$$

(b) When $W<q<L-W$, each of the side edges of the sheet P falls out of the area α, and therefore, the control section C determines the reference value of the distance X, that is, as $$X=D/2 \quad (3)$$

(c) When $L-W \leq q<L$, each of the side edges of the sheet P falls within the area α, and therefore, the control section C determines the reference value of the distance X in such a way that each of the side edges of the sheet P is positioned outside of the area α, that is, as $$X=L/2+L\times(p+1) \quad (4)$$

(ii) In area β:

The control section C determines values r and s in accordance with the following equation:

$$[(D/2-(M/2+(L-M))]/L=r \ldots s \quad (5)$$

Then the control section C determines the reference value of the distance X in each of the following three cases relative to the value of s.

(a) When $0 \leq s \leq W$, each of the side edges of the sheet P falls within the area β, and therefore, the control section C determines the reference value of the distance X in such a way that each of the side edges of the sheet P is positioned outside of the area β, that is, as $$X=L/2+L\times r \quad (6)$$

(b) When $W<s<L-W$, each of the side edges of the sheet P falls out of the area β, and therefore, the control section C determines the reference value of the distance X, that is, as $$X=D/2 \quad (7)$$

(c) When $L-W \leq s<L$, each of the side edges of the sheet P falls within the area β, and therefore, the control section C determines the reference value of the distance X in such a way that each of the side edges of the sheet P is positioned outside of the area β, that is, as $$X=L/2+L\times(r+1) \quad (8)$$

In the above-described preferred embodiment, the sheet is fed from the conveyor belt 2 of the sheet feeding section A to the buckle 10 of the sheet folding section B in such a way that the center axis of the sheet P matches with the center axis of the buckle 10, and that the reference point O in the direction perpendicular to the conveyance direction R is set on the center axes both of the buckle 10 and the conveyor belt 2. However, a method for determination of the reference value of the distance is not limited to those premised on the above. For example, the sheet may be fed from the conveyor belt 2 of the sheet feeding section A to the buckle 10 of the sheet folding section B in such a manner that one side edge of the sheet P matches with one side edge of the sheet feed clearance of the buckle 10, and that the reference point O in the direction perpendicular to the conveyance direction R is set at one side edge of the sheet feed clearance of the buckle 10.

In this manner, in the sheet folding apparatus according to the present invention, the reference value of the distance from the reference point to the guide plate in the direction perpendicular to the conveyance direction R is determined prior to the start of the sheet folding operation in such a manner that each of the side edges of the sheet P to be fed into the sheet feed clearance 14 of the buckle 10 is separated by not less than the predetermined distance from the side edges 12*c* and 12*d* of the bar 12 positioned nearest the side edges of the sheet P, and the guide plate 4 is positioned according to the reference value of the distance. As a consequence, during the insertion of the sheet P into the sheet feed clearance 14 of the buckle 10, the side edges of the sheet P are not brought into contact with the side edges 12*c* and 12*d* of the bar 12 of the buckle 10, and therefore, the sheet P is accurately aligned at the predetermined folding position all the time without any deviation of the folding position.

EXPLANATION OF REFERENCE NUMERALS

1 rack
2 conveyor belt
2*a* conveying surface
3 feed roller
4 guide plate
5 frame
6 feed screw
7 motor
8 movable block
9 guide rail
10 buckle
11 outer frame
11*a*, 11*b* pair of sides
12 bar
12*a*, 12*b* bar element
13 slot
14 sheet feed clearance
15 stopper
16, 17 inlet rollers
17, 18 folding rollers
19 data input section
20 data storage section
A sheet feeding section
B sheet folding section
C control section
P sheet
R conveyance direction (sheet feeding direction)
S sheet stack

The invention claimed is:

1. A sheet folding apparatus comprising:

a sheet feeding section for sequentially feeding sheets from a sheet stack;

a sheet folding section for folding the sheet fed from the sheet feeding section at a right angle to a sheet feeding direction; and a control section for controlling the sheet feeding section and the sheet folding section;

wherein the sheet feeding section includes:

a rack on which the sheet stack is placed;

a conveyor belt extending between the rack and the sheet folding section and being rotationally driven;

a sheet feeder for sequentially feeding the sheets from the sheet stack onto a conveying surface of the conveyor belt;

a guide plate extending in a conveyance direction on the conveying surface of the conveyor belt so as to align the sheet conveyed on the conveying surface; and a guide plate drive mechanism for moving the guide plate on the conveying surface in a direction perpendicular to the conveyance direction, the sheet being brought into contact with the guide plate at one side edge thereof while being conveyed on the conveying surface;

wherein the guide plate drive mechanism includes:

a frame;

a feed screw extending across a clearance defined between the upper and lower sides of the conveyor belt at a right angle to the conveyance direction and supported by the frame so as to be rotated around an axis thereof;

a motor fixed to the frame and connected to one end of the feed screw so as to rotationally drive the feed screw;

a movable block insertable into the clearance defined between the upper and lower sides of the conveyor belt, the feed screw being screwed through the movable block; and guide rails attached to the frame and extending in parallel to the feed screw so as to slidably guide the movable block in a direction perpendicular to the conveyance direction;

wherein the guide plate is attached to the movable block;

wherein the sheet folding section includes:

a buckle having a rectangular outer frame; and a plurality of bars, each of the plurality of bars extending between a pair of sides of the outer frame with intervals therebetween, each of the plurality of bars being composed of a pair of bar elements arranged with a clearance in a thickness direction of the outer frame, a slot being formed at one side of the pair of sides of the outer frame and extending in an array direction of the bars so as to communicate with the clearance defined between the pair of bar elements of each of the bars, a sheet feed clearance being formed inside of the buckle and extending in a length direction of the bars from the slot, the buckle being arranged in such a way that the slot is oriented toward the conveyor belt;

wherein the sheet folding section further includes:

a stopper arranged on the way of the sheet feed clearance of the buckle for positioning the sheet at a predetermined folding position by the leading edge of the sheet abutting against the stopper;

a pair of inlet rollers arranged immediately before the slot of the buckle for rotation around a rotary shaft which extends at a right angle to the conveyance direction, the pair of the inlet rollers nipping the sheet fed from the conveyor belt so as to feed the sheet into the sheet feed clearance of the buckle; and a pair of folding rollers arranged in parallel to the inlet rollers and rotationally driven for folding a portion of the sheet bent outside of the buckle; and wherein the control section includes:

a data storage section for storing data of bar position representing a distance from a reference point in a direction perpendicular to the conveyance direction to both side edges of the bar of the buckle; and a data input section for receiving an input of data of a sheet size;

the control section executing the arithmetic processing of the data of the sheet size and the data of the bar position prior to the start of a sheet folding operation so as to determine the reference value of a distance from the reference point to the guide plate in a direction perpendicular to the conveyance direction in such a manner that each of the side edges of the sheet to be fed into the sheet feed clearance of the buckle is separated by not less than the predetermined distance from side edges of the bar positioned nearest the side edges of the sheet, and setting a position of the guide plate in accordance with the reference value of the distance.

2. The sheet folding apparatus according to claim 1, wherein, when the sheet is fed from the conveyor belt of the sheet feeding section to the buckle of the sheet folding section in such a manner that the center axis of the sheet matches with the center axis of the buckle and when the reference point in the direction perpendicular to the conveyance direction is set on the center axes both of the buckle and the conveyor belt, in the arithmetic processing, the control section calculates a quotient p and a remainder q when dividing (D/2−M/2) by L in accordance with the following equation:

(i)

$$(D/2-M/2)/L=p \ldots q$$

wherein D represents a width of the sheet, L represents an interval between the bars, and M represents a width of the clearance defined between the adjacent bars, and, (ii) when $0 \le q \le W$, wherein W represents the predetermined distance between each of the side edges of the sheet and the side edges of the bar positioned nearest the side edges of the sheet, the control section determines the reference value of the distance X from the reference point to the guide plate as:

$$X=L/2+L\times p$$

(iii) when $W<q<L-W$, the control section determines the reference value of the distance X as:

$$X=D/2$$

(iv) when $L-W \le q<L$, the control section determines the reference value of the distance X as:

$$X=L/2+L\times(p+1)$$

and further, the control section calculates a quotient r and a remainder s when dividing [(D/2−(M/2+(L−M))] by L in accordance with the following equation:

(v)

$$[(D/2-(M/2+(L-M))]/L=r \ldots s$$

and, (vi) when $0 \le s \le W$, the control section determines the reference value of the distance X as:

$$X=L/2+L\times r$$

(vii) when $W<s<L-W$, the control section determines the reference value of the distance X as:

$X=D/2$ (viii) when $L-W \leq q < L$, the control section determines the reference value of the distance X as:

$X=L/2+L\times(r+1)$.

* * * * *